US008685912B2

(12) United States Patent
Maeyama et al.

(10) Patent No.: US 8,685,912 B2
(45) Date of Patent: Apr. 1, 2014

(54) DETERGENT FOR METAL

(75) Inventors: Shigeru Maeyama, Souka (JP); Kei Tamura, Funabashi (JP); Akira Shinohara, Tokyo (JP); Keita Someya, Minamiashigara (JP)

(73) Assignee: Lion Corporation, Tokyo (JP)

( * ) Notice: Subject to any disclaimer, the term of this patent is extended or adjusted under 35 U.S.C. 154(b) by 0 days.

(21) Appl. No.: 13/580,557

(22) PCT Filed: Feb. 23, 2011

(86) PCT No.: PCT/JP2011/054027

§ 371 (c)(1),
(2), (4) Date: Aug. 22, 2012

(87) PCT Pub. No.: WO2011/105449

PCT Pub. Date: Sep. 1, 2011

(65) Prior Publication Data

US 2012/0316097 A1 Dec. 13, 2012

(30) Foreign Application Priority Data

Feb. 23, 2010 (JP) ..... 2010-037286

(51) Int. Cl.

| | |
|---|---|
| ***C11D 1/04*** | (2006.01) |
| ***C11D 1/72*** | (2006.01) |
| ***C11D 1/722*** | (2006.01) |
| ***C11D 3/30*** | (2006.01) |

(52) U.S. Cl.

USPC ..... 510/245; 510/264; 510/271; 510/421; 510/423; 510/433; 510/475; 510/488; 510/499

(58) Field of Classification Search

USPC ..... 510/245, 264, 271, 421, 423, 433, 475, 510/488, 499

See application file for complete search history.

(56) References Cited

U.S. PATENT DOCUMENTS

| | | | | |
|---|---|---|---|---|
| 5,935,920 | A * | 8/1999 | Geke et al. | 510/245 |
| 2004/0063597 | A1 | 4/2004 | Adair et al. | |

FOREIGN PATENT DOCUMENTS

| | | |
|---|---|---|
| JP | A-04-193308 | 7/1992 |
| JP | A-05-222397 | 8/1993 |
| JP | A-06-306662 | 11/1994 |
| JP | A-07-258690 | 10/1995 |
| JP | A-08-311492 | 11/1996 |
| JP | B-2923410 | 7/1999 |
| JP | A-11-286698 | 10/1999 |
| JP | B-2962816 | 10/1999 |
| JP | A-2002-275483 | 9/2002 |
| JP | A-2005-002196 | 1/2005 |
| JP | A-2007-016263 | 1/2007 |
| JP | A-2007-204597 | 8/2007 |
| JP | B-4140453 | 8/2008 |
| JP | B-4204091 | 1/2009 |

OTHER PUBLICATIONS

International Search Report for International Application No. PCT/JP2011/054027 mailed May 24, 2011.

* cited by examiner

*Primary Examiner* — Brian P Mruk
(74) *Attorney, Agent, or Firm* — Merchant & Gould P.C.

(57) ABSTRACT

A detergent composition for metal according to the present invention contains a specific non-ionic surfactant, a specific nitrogen-containing organic compound, a specific carboxylic acid or salt thereof, and a specific alkanol amine, and has a pH of at least 9 that is measured at 25° C. when the detergent composition is diluted to 1% by mass of an aqueous solution. According to the present invention, the detergent composition for metal having excellent corrosion inhibition properties, excellent effluent treatment properties, excellent foaming suppressing properties and excellent liquid stability in addition to high detergent properties for metal, can be provided.

17 Claims, No Drawings

DETERGENT FOR METAL

TECHNICAL FIELD

The present invention relates to a detergent for metal such as iron.

This application is a U.S. National Stage Application under 35 U.S.C. §371 of International Patent Application No PCT/JP2011/054027, filed 23 Feb. 2011, which claims benefit of Serial No. 2010-037286, filed 23 Feb. 2010 in Japan and which applications are incorporated herein by reference. To the extent appropriate, a claim of priority is made to each of the above disclosed applications. The International Application was published in Japanese on 1 Sep. 2011 as WO 2011/105449.

BACKGROUND ART

Generally, when cutting and polishing metal, a cutting oil has been used to remove the frictional heat generated during processing.

In addition to the above lubricating oil and cutting oil, cutting debris and polishing debris are attached to the metal parts obtained by metal processing. However, if the metal parts are used while adhering these fouling, degradation of performance and quality of the resulting metal may occur. Therefore, the metal cutting and polishing usually have a process to wash the metal parts by using a detergent after processing.

In a detergent for metal, corrosion inhibition properties with respect to metal is required. As a detergent for metal having corrosion inhibition properties, for example, Patent Document 1 discloses a detergent composition containing a carboxylic acid, an alkanolamine and a diamine. In addition, Patent Document 2 discloses a detergent containing an alkylene oxide, an aliphatic carboxylic acid and an alkanolamine.

However, the detergents described in Patent Documents 1 and 2 have a problem that it is not easy to remove them from effluent by effluent treatment. For the reason that awareness of environmental issues has increased in recent years, improving of the properties of effluent treatment of detergent has become an important issue. In addition, if effluent treatment of detergents can be easily conducted, the cost of effluent treatment can be reduced.

As a detergent composition with excellent effluent treatment properties, for example, Patent Document 3 discloses a detergent composition containing a nonionic surfactant and an organic material having a phenolic hydroxyl group. Patent Document 4 discloses a detergent containing a nonionic surfactant, a carboxylic acid salt and an inorganic or organic alkali builder. However, detergents described in Patent Documents 3 and 4 are insufficient in corrosion inhibition properties.

PRIOR ART DOCUMENTS

Patent Documents

[Patent Document 1] Japanese Patent No. 2923410

[Patent Document 2] Japanese Patent No. 4204091

[Patent Document 3] Japanese Unexamined Patent Application, First Publication No. Hei 7-258690

[Patent Document 4] Japanese Unexamined Patent Application, First Publication No. Hei 5-222397

DISCLOSURE OF INVENTION

Problems to be Solved by the Invention

As mentioned above, detergents described in Patent Documents 1 to 4 could not achieve both corrosion inhibition properties and effluent treatment properties. In addition, better detergency performance is required, and conventional detergents cannot meet such requirement.

In addition, because many parts are washed in the same cleaning solution, the cleaning solution gradually becomes dirty by mixing cutting oil and metal powder. Therefore, in the case of spray washing using a high-pressure spray, the detergent contaminated with cutting oil may foam. Foaming suppressing properties that can be controlled is required. If the deterioration of detergency performance and corrosion inhibition properties of detergent is observed, the cleaning solution is treated as a waste solution of cleaning solution. Therefore, a detergent with excellent effluent treatment properties is also required. In addition, from the viewpoint of the issue of place for the storage of large amounts of detergent, and from the viewpoint of improving the handling of detergent, concentrated type detergent has been demanded.

Under the circumstance, the present invention has a object to provide a detergent for metal having excellent corrosion inhibition properties, excellent effluent treatment properties, excellent foaming suppressing properties and excellent liquid stability, in addition to high detergent properties for metal.

Furthermore, the present invention also has an object to provide a detergent for metal having foaming suppressing properties in spray cleaning, excellent detergent properties, excellent corrosion inhibition properties, excellent effluent treatment properties, and excellent liquid stability even of the concentrated type detergent.

Here, each of excellent detergent properties, excellent corrosion inhibition properties, excellent effluent treatment properties, excellent foaming suppressing properties, and excellent liquid stability has been described based on the following definition.

Detergent properties: A cleaning solution which was able to sufficiently eliminate the residual metal debris (such as iron powder) adhered to the metal parts after cutting of metal, was defined as the cleaning solution having excellent detergent properties.

Corrosion inhibition properties: A cleaning solution which was able to prevent or suppress the occurrence of corrosion even if iron powder (or aluminum piece) is treated in the detergent composition, was defined as the detergent having excellent corrosion inhibition properties.

Effluent treatment properties: A detergent composition in which the COD value thereof may be reduced to 1800 ppm or less when the value was measured by a test method for effluent treatment properties using the cleaning composition diluted to 1% by mass according to JISK0102, standard number of 17 was defined as the detergent composition having excellent effluent treatment properties.

Foaming suppressing properties: A cleaning solution which was able to suppress foaming even if detergent composition was shaken under the condition that a certain amount of water-soluble cutting oil was coexisted, was defined as the cleaning liquid having excellent foaming suppressing properties.

Liquid stability: A detergent composition in which irrecoverable precipitation or cloudiness did not occur, even if the composition was stored at minus 5° C., was defined as the detergent composition having excellent liquid stability.

Means for Solving the Problems

A detergent composition for metal according to the present invention is characterized by containing a component (A), a component (B), a component (C) and a component (D) as described below, and having a pH of at least 9 that is measured at 25° C. when the detergent composition is diluted to 1% by mass of an aqueous solution;

a component (A): a nonionic surfactant of at least one selected from the group consisting of a polyoxyalkylene alkyl ether (A1) represented by following general formula (I) and a polyoxyalkylene alkyl amine (A2) represented by following general formula (II).

[Chemical Formula 1]

$$R^1O(EO)_{n1}(PO)_{m1}H \quad (I)$$

In the formula, $R^1$ represents an alkyl group of 8 to 11 carbon atoms or an alkenyl group of 8 to 11 carbon atoms; EO represents an ethyleneoxy group; PO represents a propyleneoxy group; n1 represents an average addition mole number of EO and is an integer of 1 to 10; m1 represents an average addition mole number of PO and is an integer of 0 to 5.

[Chemical Formula 2]

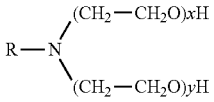

(II)

In the formula, R represents an alkyl group of 8 to 18 carbon atoms or an alkenyl group of 8 to 18 carbon atoms; X and Y represents the average number of moles of ethyleneoxy group; and the sum of X and Y is an integer of 3 to 10.

a component (B): a nitrogen-containing organic compound of at least one selected from the group consisting of an amine compound (B1) represented by following general formula (III), an allylamine-based polymer (B6) having a weight-average molecular weight of 5,000 to 50,000 and a polyethyleneimine (B5) having a weight-average molecular weight of 5,000 to 50,000 and having a structural unit represented by following general formula (IV);

[Chemical Formula 3]

$$R^2—Z—(CH_2)_3—NH_2 \quad (III)$$

In the formula, $R^2$ represents an alkyl group of 7 to 14 carbon atoms or an alkenyl group of 7 to 14 carbon atoms; and Z represents —O— or —NH—.

[Chemical Formula 4]

$$—(CH_2CH_2NH)— \quad (IV)$$

a component (C): a carboxylic acid or a salt thereof selected from the group consisting of an aliphatic carboxylic acid of 4 to 12 carbon atoms or a salt thereof (C1) and an aromatic carboxylic acid of 7 to 12 carbon atoms or a salt thereof (C2).

a component (D): an alkanol amine compound of at least one selected from the group consisting of an amine compound (D1) having a linear alkanol group, represented by following general formula (V) and an amine compound (D2) having a branched alkanol group, represented by following general formula (VI).

[Chemical Formula 5]

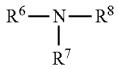

(V)

In the formula, $R^6$, $R^7$, and $R^8$ each independently represents a hydrogen atom or a linear alkanol group of 2 to 4 carbon atoms; provided that all of $R^6$, $R^7$ and $R^8$ are not a hydrogen atom at the same time.

[Chemical Formula 6]

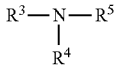

(VI)

In the formula, $R^3$, $R^4$, and $R^5$ each independently represent a hydrogen atom or a branched alkanol group of 3 to 6 carbon atoms; provided that all of $R^3$, $R^4$ and $R^5$ are not a hydrogen atom at the same time.

In the detergent composition for metal according to the first aspect of the present invention, the component (A) is preferably the polyoxyalkylene alkyl ether (A1).

In the detergent composition for metal according to the first aspect of the present invention, the component (B) is preferably the amine compound (B1).

In the detergent composition for metal according to the first aspect of the present invention, the component (C) is preferably the aliphatic carboxylic acid of 4 to 12 carbon atoms or a salt thereof (C1).

In the detergent composition for metal according to the first aspect of the present invention, the component (D) is preferably the amine compound (D2) having a branched alkanol group.

In the detergent composition for metal according to the second aspect of the present invention, the component (A) is preferably the polyoxyalkylene alkyl ether (A1); and the component (B) is preferably at least one selected from the group consisting of the alylamine-based polymer (B6) and the polyethyleneimine (B5).

In the detergent composition for metal according to the second aspect of the present invention, the component (D) is preferably the amine compound (D2) having a branched alkanol group.

In the detergent composition for metal according to the second aspect of the present invention, the allylamine-based polymer (B6) is preferably at least one selected from the group consisting of a monoallylamine-based polymer (B2) having a weight-average molecular weight of 5,000 to 50,000 and having a structural unit represented by following general formula (VII), and a diallylamine-based polymer (B7).

[Chemical Formula 7]

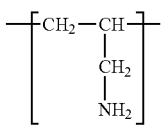

(VII)

In the detergent composition for metal according to the second aspect of the present invention, the diallylamine-based polymer (B7) is preferably a polymethyldiallylamine hydrochloride (B3) having a weight-average molecular weight of 5,000 to 50,000 and having a structural unit represented by following general formula (VIII), or a polydiallyldimethylammonium chloride (B4) having a weight-average molecular weight of 5,000 to 50,000 and having a structural unit represented by following general formula (IX).

[Chemical Formula 8]

(VIII)

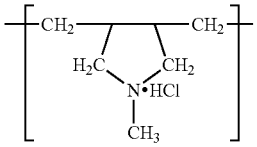

[Chemical Formula 9]

(IX)

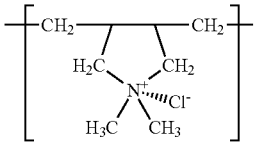

In the detergent composition for metal according to the third aspect of the present invention, the component (A) is preferably the polyoxyalkylene alkyl amine (A2).

In the detergent composition for metal according to the third aspect of the present invention, the component (B) is preferably the amine compound (B1).

In the detergent composition for metal according to the third aspect of the present invention, the component (D) is preferably the amine compound (D1) having a linear alkanol group.

In the detergent composition for metal according to the third aspect of the present invention, the component (D) is preferably the amine compound (D2) having a branched alkanol group.

In the detergent composition for metal according to the fourth aspect of the present invention, the component (A) is preferably the polyoxyalkylene alkyl amine (A2); and the component (B) is preferably at least one selected from the group consisting of the alylamine-based polymer (B6) and the polyethyleneimine (B5).

In the detergent composition for metal according to the fourth aspect of the present invention, the component (D) is preferably the amine compound (D1) having a linear alkanol group.

In the detergent composition for metal according to the fourth aspect of the present invention, the component (D) is preferably the amine compound (D2) having a branched alkanol group.

In the detergent composition for metal according to the fourth aspect of the present invention, the allylamine-based polymer (B6) is preferably at least one selected from the group consisting of a monoallylamine-based polymer (B2) having a weight-average molecular weight of 5,000 to 50,000 and having a structural unit represented by following general formula (VII), and a diallylamine-based polymer (B7).

[Chemical Formula 10]

(VII)

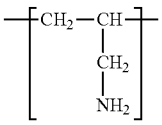

In the detergent composition for metal according to the fourth aspect of the present invention, the diallylamine-based polymer (B7) is preferably a polymethyldiallylamine hydrochloride (B3) having a weight-average molecular weight of 5,000 to 50,000 and having a structural unit represented by following general formula (VIII), or a polydiallyldimethylammonium chloride (B4) having a weight-average molecular weight of 5,000 to 50,000 and having a structural unit represented by following general formula (IX).

[Chemical Formula 11]

(VIII)

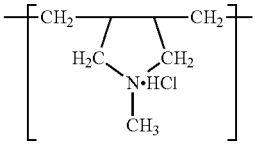

[Chemical Formula 12]

(IX)

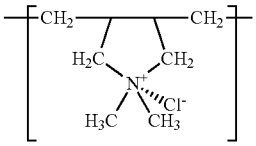

In the detergent composition for metal according to the first to fourth aspects of the present invention, further containing a sodium silicate is preferable.

In the detergent composition for metal according to the first to fourth aspects of the present invention, the total amount of the component (A), the component (B), the component (C) and the component (D) is greater than or equal to 20% by mass, relative to the total amount of the detergent composition as high as 100% by mass. In addition, it is preferable that the total amount of the components (A) to (D) is at least 50% by mass, and the amount of the component (A), the amount of the component (B), the amount of the component (C) and the amount of the component (D) each fulfill following formula because excellent liquid stability can be exhibited. It is noted that component other than (A), (B), (C) and (D) is mostly water (component E).

$$\{(\text{the amount of the component } (A))+(\text{the amount of the component } (B))\}/\{(\text{the amount of the component } (C))+(\text{the amount of the component } (D))\}\leq 0.6$$

Effects of the Invention

The detergent composition for metal of the present invention has excellent corrosion inhibition properties, excellent effluent treatment properties, excellent foaming suppressing properties and excellent liquid stability, in addition to high detergent properties for metal.

Furthermore, the detergent composition for metal of the present invention also has foaming suppressing properties in spray cleaning, excellent detergent properties, excellent corrosion inhibition properties, excellent effluent treatment properties, and excellent liquid stability even of the concentrated type of detergent composition.

BEST MODE FOR CARRYING OUT THE INVENTION

The detergent composition for metal of the present invention (hereinafter, referred to as "detergent") contains a component (A) (a nonionic surfactant), a component (B) (a nitrogen-containing organic compound), a component (C) (a carboxylic acid or salt thereof) and a component (D) (an alkanolamine compound).

[Component (A): Nonionic Surfactant]

The nonionic surfactant as a component (A) is a nonionic surfactant of at least one group selected from the group consisting of a polyoxyalkylene alkyl ether (A1) represented by following general formula (I) and a polyoxyalkylene alkyl amine (A2) represented by following general formula (II).

[Chemical Formula 13]

$$R^1O(EO)_{n1}(PO)_{m1}H \quad (I)$$

In the formula, $R^1$ represents an alkyl group of 8 to 11 carbon atoms or an alkenyl group of 8 to 11 carbon atoms; EO represents an ethyleneoxy group; PO represents a propyleneoxy group; n1 represents an average addition mole number of EO and is an integer of 1 to 10; and m1 represents an average addition mole number of PO and is an integer from 0 to 5.

[Chemical Formula 14]

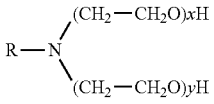

(II)

In the formula, R represents an alkyl group of 8 to 18 carbon atoms or an alkenyl group of 8 to 18 carbon atoms; X and Y represents the average number of moles of ethyleneoxy group; and the sum of X and Y is an integer of 3 to 10.

The component (A) is a surfactant to provide both foaming suppressing properties and detergent properties.

In the general formula (I), $R^1$ is an alkyl group of 8 to 11 carbon atoms or an alkenyl group of 8 to 11 carbon atoms, and preferably an alkyl group of 8 to 10 carbon atoms or an alkenyl group of 8 to 10 carbon atoms. If the number of carbon atoms of $R^1$ is within the range from 8 to 11, detergent properties become excellent.

In general formula (I), EO is an ethyleneoxy group, and PO is a propyleneoxy group. Each of ethyleneoxy group and propyleneoxy group is a structural unit formed by addition polymerization of ethylene oxide and propylene oxide. An addition form of EO and PO may be a block or a random. EO enhances detergent properties, and PO has the effect of increasing the foaming suppressing properties during cleaning.

n1 is the average addition mole number of EO. n1 is 1 to 10, preferably 3 to 6, and more preferably 4 to 6. If n1 is greater than or equal to 1, the detergent properties become excellent. If n1 is less than or equal to 10, the foaming suppressing properties during cleaning becomes excellent and the composition becomes suitable for use as a detergent composition.

m1 is the average addition mole number of PO. m1 is 0 to 5, and preferably 0 to 2. If m1 is greater than or equal to 0, the foaming suppressing properties during cleaning becomes excellent and the composition becomes suitable for use as a detergent composition. If m1 is less than or equal to 5, the detergent properties becomes excellent.

With respect to the aforementioned average addition mole number n1 and m1, it is preferable that n1 is within the range from 3 to 6 and m1 is within the range from 0 to 2. Further, it is more preferable that n1 is 4 or 5 and m1 is 0.

Specific examples of the aforementioned polyoxyalkylene alkyl ether (A1) include polyoxyethylene mono 2-ethylhexylether (the average addition mole number of EO is 4) (such as polyoxyethylene decyl ether, manufactured by Nippon Nyukazai Co., Ltd., product name: Newcall 1004), polyoxyethylene decyl ether (the average addition mole number of EO is 5) (manufactured by Dai-ichi Kogyo Seiyaku Co., Ltd., product name: Noigen XL-40), polyoxyethylene decyl ether (the average addition mole number of EO is 6) (manufactured by Dai-ichi Kogyo Seiyaku Co., Ltd., product name: Noigen XL-50), polyoxyethylene decyl ether (the average addition mole number of EO is 6) (manufactured by Dai-ichi Kogyo Seiyaku Co., Ltd., product name: Noigen XL-60) and a compound in which PO is added to polyoxyethylene decyl ether (the average addition mole number of EO is 6) by block addition in the presence of an alkali catalyst.

The amount of the polyoxyalkylene alkyl ether (A1) is preferably 1 to 30% by mass, more preferably 5 to 25% by mass, further preferably 10 to 20% by mass, and particularly preferably 7 to 15% by mass, when the entire detergent composition is 100% by mass. If the amount of the polyoxyalkylene alkyl ether (A1) is greater than or equal to 1% by mass, the detergent properties is further enhanced. If the amount is less than or equal to 30% by mass, the sufficient liquid stability can be obtained, and the composition becomes suitable for use as detergent composition.

In general formula (II), R preferably has 8 to 18 carbon atoms, more preferably has 12 to 18 carbon atoms, and particularly preferably has 14 to 18 carbon atoms. If it is greater than or equal to the lower limit, the detergent properties become excellent. If it is less than or equal to the upper limit, the detergent properties becomes excellent.

The sum of X and Y that are the average addition mole numbers of ethyleneoxy group is preferably 3 to 10, more preferably 5 to 10, further preferably 3 to 6, and particularly preferably 3 to 5. If it is greater than or equal to lower limit, the detergent properties becomes excellent. If it is less than or equal to the upper limit, the foaming suppressing properties becomes excellent.

Examples of polyoxyalkylene alkyl amine (A2) include polyoxyethylene dodecyl amine (in which the average addition mole number of EO is 5 (manufactured by Lion Akzo Co., Ltd., product name: Ethomeen C/15)), polyoxyethylene octadecyl amine (in which the average addition mole number of EO is 5 (manufactured by Lion Akzo Co., Ltd., product name: Ethomeen T/15)), polyoxyethylene octadecyl amine (in which the average addition mole number of EO is 10 (manufactured by Lion Akzo Co., Ltd., product name: Ethomeen T/20)), and the like.

These components (A) may be used alone, or a combination of two or more.

The amount of the polyoxyalkylene alkyl amine (A2) is preferably 1 to 30% by mass, more preferably 3 to 15% by mass, further preferably 5 to 10% by mass, and particularly preferably 5 to 7% by mass, when the entire detergent composition is 100% by mass. If the amount of the polyoxyalkylene alkyl amine (A2) is greater than or equal to 1% by mass, the detergent properties become excellent. If the amount is less than or equal to 30% by mass, the sufficient liquid stability can be obtained, and the compositon becomes suitable for use as detergent composition.

Among these, as the component (A), the polyoxyalkylene alkyl amine (A2) is preferable because detergent properties, foaming properties and corrosion inhibition properties become excellent.

[Component (B): Nitrogen-Containing Organic Compound]

The component (B) is a nitrogen-containing organic compound of at least one selected from the group consisting of an amine compound (B1) represented by following general formula (III), an allylamine-based polymer (B6) having a weight-average molecular weight of 5,000 to 50,000 and a polyethylene imine (B5) having a weight-average molecular weight of 5,000 to 50,000 and having a structural unit represented by following general formula (IV).

The component (B) is able to increase the corrosion inhibition properties and forming suppressing properties.

[Chemical Formula 15]

$$R^2—Z—(CH_2)_3—NH_2 \quad (III)$$

In the formula, $R^2$ represents an alkyl group of 7 to 14 carbon atoms or an alkenyl group of 7 to 14 carbon atoms; and Z represents —O— or —NH—.

[Chemical Formula 16]

$$—(CH_2CH_2NH)— \quad (IV)$$

As the allylamine-based polymer (B6), examples include a monoallylamine-based polymer (B2) having a weight-average molecular weight of 5,000 to 50,000 and having a structural unit represented by following the general formula (VII), and a diallylamine-based polymer (B7).

[Chemical Formula 17]

(VII)

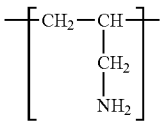

Here, the nitrogen-containing organic compound means an organic compound having a nitrogen atom. The allylamine-based polymer means a polymer in which allyamines are polymerized as monomers, and may be a monoallylamine-based polymer or a diallylamine-based monomer. The monoallylamine-based polymer means a polymer in which monoallylamines are polymerized as monomers. In addition, the diallylamine-based polymer means a polymer in which diallylamines are polymerized as monomers. The nitrogen atom within a monoallylamine and a diallylamine may or may not have a substituent such as an alkyl group.

Examples of the diallylamine-based polymer (B7) include a polymethyldiallylamine hydrochloride (B3) having a weight-average molecular weight of 5,000 to 50,000 and having a structural unit represented by following the general formula (VIII) and a polydiallyldimethylammonium chloride (B4) having a weight-average molecular weight of 5,000 to 50,000 and having a structural unit represented by following general formula (IX).

[Chemical Formula 18]

(VIII)

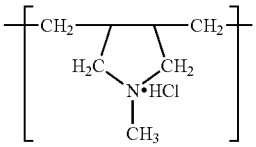

[Chemical Formula 19]

(IX)

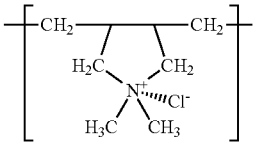

Specific examples of the amine compound (B1) represented by the general formula (III) include an alkyl diamine and an alkyloxoamine.

Here, the alkyloxoamine means an amine having an alkoxyalkyl group and in the general formula (III), Z is —O—. If Z is —O— in the general formula (III), $R^2$ is an alkyl group of 7 to 14 carbon atoms, preferably 9 to 11 carbon atoms. In addition, the alkyldiamine means an amine in which $R^2$ is an alkyl group of 7 to 14 carbon atoms, preferably 12 to 14 carbon atoms, and Z is —NH— in the general formula (III). If the number of carbon atoms of $R^2$ in a component (B) is greater than or equal to lower limit, the corrosion inhibition properties becomes high. On the other hand, if the number of carbon atoms of $R^2$ in a component (B) is less than or equal to the upper limit, the foaming suppressing properties becomes high, and because suitable for use as a detergent.

Z in the general formula (III) is —O— or —NH, and in terms of higher corrosion inhibition properties, —O— is preferred.

Specific examples of the amine compound (B1) include an alkyl diamine: $C_nH_{2n+1}NHC_3H_6NH_2$ (n=12 to 14) (manufactured by Lion Akzo Co., Ltd., product name: Duomin CD), an alkyloxoamine: $C_nH_{2n+1}OC_3H_6NH_2$ (n=9 to 11) (manufactured by NOF Co., Ltd., product name: amine M14) and the like.

In the first aspect of the present invention, the component (A) is a polyoxyalkylene alkyl ether (A1) and the component (B) is an amine compound (B1). In particular, in the general formula (III), Z is preferably —O— (that is, an oxygen atom) because of the low foaming properties.

Specific examples of the allylamine-based polymer (B6) include the polymer compounds described in Japanese Patent No. 2,962,816, Japanese Patent No. 4,140,453, and Japanese published unexamined application No. 2007-204597. Among these polymers, a monoallylamine-based polymer (B2), a polymethyldiallylamine hydrochloride (B3), and a polydiallyldimethylammonium chloride (B4) are preferred. Specifically, as a monoallylamine-based polymer (B2), a polymer manufactured by Nittobo Co., Ltd. and having the weight-average molecular weight of 15,000 and the product name of PAA15C is more preferable. As a polymethyldiallylamine hydrochloride (B2), a polymer manufactured by Nittobo Co., Ltd. and having the weight-average molecular weight of 20,000 and the product name of PAS-M1 is more preferable. As a polydiallyldimethylammonium chloride (B4), a polymer manufactured by Nittobo Co., Ltd. and having the weight-average molecular weight of 40,000 and the product name of PAS-H5L is more preferable.

As a polyethyleneimine (B5), a polymer manufactured by Nippon Shokubai Co., Ltd. and having the molecular weight of 10,000 and the product name of EpoinSP-200 is more preferable.

These components (B) may be used alone, or a combination of two or more.

As the monoallylamine-based polymer (B2), the polymethyldiallylamine hydrochloride (B3), the polydiallyldimethylammonium chloride (B4) and polyethyleneimine (B5), polymers having the weight-average molecular weight of 5,000 to 50,000 are preferred. Furthermore, polymers having the weight-average molecular weight of 5,000 to 40,000 are preferable in terms of liquid stability.

In particular, a weight average molecular weight of each compound having a structural unit represented by the formula (VI), (VII), (VIII) or (IX) is from 5,000 to 50,000. In terms of liquid stability, 5,000 to 40,000 is more preferable.

It should be noted that the weight-average molecular weight can be measured by following method described in Japanese Patent No. 4140453 and Japanese published unexamined application No. 2007-204597.

[Method for Measuring Weight-Average Molecular Weight of Polymer]

A weight-average molecular weight of a polymer (Mw) was measured by gel permeation chromatography (GPC) using a high-performance liquid chromatograph of Hitachi L-6000 type. The eluent flow path pump of Hitachi L-6000, the detector of differential refractive index detector index of Shodex RISE-61, the column that GS-220HQ (the molecular weight exclusion limit is 3,000) and GS-620HQ (the molecular weight exclusion limit is 2,000,000) of Asahipack aqueous gel filtration type were connected in series, are used. The sample was adjusted to a concentration of 0.5 g/100 ml with the eluent, and using 20 μl. As the eluent, an aqueous solution of sodium chloride of 0.4 mol/l was used. Column temperature was 30° C., and flow rate was 1.0 ml/minute. Calibration curve was obtained using polyethylene glycols having molecular weight of 106, 194, 440, 600, 1470, 4100, 7100, 10300, 12600, and 23000 as standard samples, and the weight average molecular weight of copolymer was calculated based on the calibration curve.

In the first to fourth aspects of the present invention, the amount of component (B) is preferably 1 to 10% by mass, more preferably 2 to 8% by mass, further preferably 3 to 7% by mass, and particularly preferably 3 to 5% by mass, when the entire detergent composition is 100% by mass. If the amount of component (B) is greater than or equal to 1% by mass, the corrosion inhibition properties and foaming suppressing properties becomes high. If the amount of component (B) is less than or equal to 10% by mass, the detergent properties becomes high, and suitable for use as detergent composition.

[Component (C): Carboxylic Acid or Salt Thereof]

The component (C) is an aliphatic carboxylic acid of 4 to 12 carbon atoms or a salt thereof (C1) or an aromatic carboxylic acid of 7 to 12 carbon atoms or a salt thereof (C2).

The component (C) is a component to provide corrosion inhibition properties for metal and liquid stability for detergent. The number of total carbon atoms of aliphatic carboxylic acid is 4 to 12, and preferably 8 to 12. If the number of total carbon atoms is greater than or equal to 4, the corrosion inhibition properties becomes high. If the number of total carbon atoms is less than or equal to 12, the foaming suppressing properties becomes high, and suitable for use as a detergent composition.

The number of total carbon atoms of aromatic carboxylic acid is 7 to 12, and preferably 8 to 12. If the number of total carbon atoms is greater than or equal to 7, the corrosion inhibition properties becomes high. If the number of total carbon atoms is less than or equal to 12, the foaming suppressing properties becomes high, and suitable for use as a detergent composition.

The carboxylic acid may be a monocarboxylic acid or a dicarboxylic acid. Specifically, it may be an aliphatic monocarboxylic acid, an aliphatic dicarboxylic acid, an aromatic monocarboxylic acid or an aromatic dicarboxylic acid.

As an aliphatic carboxylic acid, examples include aliphatic monocarboxylic acids such as butanoic acid, pentanoic acid, hexanoic acid, heptanoic acid, octanoic acid, nonanoic acid, decanoic acid, undecanoic acid, and dodecanoic acid; and aliphatic dicarboxylic acids such as butanedioic acid (succinic acid), pentanedioic acid, hexanedioic acid, heptanedioic acid, octanedioic acid, nonanedioic acid, decanedioic acid, undecanedioic acid, and dodecanedioic acid. Among them, octanoic acid or decanoic acid is preferable as an aliphatic monocarboxylic acid, and dodecanedioic acid is preferable as an aliphatic dicarboxylic acid.

As an aromatic carboxylic acids, examples include aromatic monocarboxylic acids such as benzoic acid and butylbenzoic acid; and aromatic dicarboxylic acids such as phthalic acid, isophthalic acid, and terephthalic acid.

These carboxylic acids may be used alone, or a combination of two or more.

In terms of corrosion inhibition properties and liquid stability, an aliphatic carboxylic acid is preferable, octanoic acid, decanoic acid and dodecanedioic acid is more preferable, and dodecanedioic acid is particularly preferable because it is superior in corrosion inhibition properties.

As a base for forming a salt, examples include inorganic bases such as sodium, potassium, calcium, and magnesium; and organic bases such as ammonia, methylamine, dimethylamine, ethylamine, diethylamine, (iso)propylamine, di(iso)propylamine, monoethanolamine, N-methyl-monoethanolamine, N-ethylmonoethanolamine, diethanolamine, triethanolamine, monopropanolamine, dipropanolamine, and tripropanolamine As a carboxylic acid salt, a carboxylic acid salt prepared in advance may be added at the time of preparation of detergent composition, or a carboxylic acid and a base may be separately added at the time of preparation of detergent composition.

In the first to fourth aspects of the present invention, the amount of component (C) is preferably 1 to 40% by mass, more preferably 5 to 30% by mass, further preferably 10 to 25% by mass, and particularly preferably 10 to 20% by mass, when the entire detergent composition is 100% by mass. If the amount of component (C) is greater than or equal to 1% by mass, the corrosion inhibition properties becomes high. If the amount of component (C) is less than or equal to 40% by mass, the liquid stability becomes excellent.

[Component (D): Alkanolamine Compound]

The component (D) is at least one selected from the group consisting of an amine compound (D1) having a linear alkanol group, represented by following general formula (V) and an amine compound (D2) having a branched alkanol group, represented by following general formula (VI).

[Chemical Formula 20]

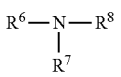

(V)

In the formula, $R^6$, $R^7$, and $R^8$ each independently represents a hydrogen atom or a linear alkanol group of 2 to 4 carbon atoms; provided that all of $R^6$, $R^7$ and $R^8$ are not a hydrogen atom at the same time.

[Chemical Formula 21]

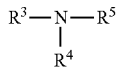

(VI)

In the formula, $R^3$, $R^4$, and $R^5$ each independently represents a hydrogen atom or a branched alkanol group of 3 to 6 carbon atoms; provided that all of $R^3$, $R^4$ and $R^5$ are not a hydrogen atom at the same time.

Here, the alkanol group means a hydroxyalkyl group. The linear alkanol group means a group in which a hydrogen atom on the terminal methyl group within linear alkyl group is replaced by a hydroxyl group.

The number of carbon atoms of linear alkanol group in general formula (V) is 2 to 4, and preferably 2 or 3. If the number of carbon atoms is within the range, it is preferable for maintaining the pH during cleaning, and for being superior in corrosion inhibition properties and effluent treatment properties.

Specific examples of linear alkanol group include 2-hydroxyethyl group, 3-hydroxy-n-propyl group and 4-hydroxy-n-butyl group. Among these, 2-hydroxyethyl group and 3-hydroxy-n-propyl group are preferred.

Specific examples of the amine compound having a linear alkanol group include monoethanolamine, diethanolamine, triethanolamine, mono-n-propanolamine and di-n-propanolamine. Among these, monoethanolamine, diethanolamine, triethanolamine and mono-n-propanolamine are preferable.

The branched alkanol group means a group in which a hydrogen atom on methylene or methine group within linear or branched alkyl group is replaced by a hydroxyl group, or a group in which a hydrogen atom on methyl group within branched alkyl group is replaced by a hydroxyl group.

The number of carbon atoms of branched alkanol group in general formula (VI) is 3 to 6, and preferably 3 to 4. If the number of carbon atoms is within the range, it is preferable for maintaining the pH during cleaning, and for being superior in corrosion inhibition properties and effluent treatment properties.

Specific examples of branched alkanol groups include 2-hydroxy-n-propyl group (—$CH_2$—CHOH—$CH_3$), 2-hydroxy-1-methylethyl group, 2-hydroxy-n-butyl group, 3-hydroxy-n-butyl group, 2-hydroxy-2-methylpropyl group, 3-hydroxy-2-methylpropyl group, hydroxy-t-butyl group, 2-hydroxy-n-pentyl group, 3-hydroxy-n-pentyl group, 4-hydroxy-n-pentyl group, 2-hydroxy-2-methylbutyl group, 3-hydroxy-2-methylbutyl group, 4-hydroxy-2-methylbutyl group, 2-hydroxy-3-methylbutyl group, 3-hydroxy-3-methylbutyl group, 4-hydroxy-3-methylbutyl group, 2-hydroxy-n-hexyl group, 3-hydroxy-n-hexyl group, 4-hydroxy-n-hexyl group and 5-hydroxy-n-hexyl group. Among these, 2-hydroxy-n-propyl group is preferred.

Specific examples of the amine compound having a branched alkanol group include monoisopropanolamine, diisopropanolamine and triisopropanolamine. Among these, monoisopropanolamine and diisopropanolamine are preferred.

In the first to fourth aspects of the present invention, the amine compound (D2) having a branched alkanol group is preferable as the component (D), because it is superior in corrosion inhibition properties and effluent treatment properties. In particular, monoisopropanolamine and diisopropanolamine are preferred.

These components (D) may be used alone, or a combination of two or more.

In the first to fourth aspects of the present invention, the amount of component (D) is preferably 1 to 50% by mass, more preferably 2 to 40% by mass, further preferably 2 to 35% by mass, and particularly preferably 2 to 32% by mass, when the entire detergent composition is 100% by mass. If the amount of component (D) is greater than or equal to 1% by mass, the corrosion inhibition properties and effluent treatment properties become high. If the amount of component (D) is less than or equal to 50% by mass, the liquid stability becomes high.

One aspect of the present invention relates to a detergent composition for metal in which a component (A) is a polyoxyalkylene alkyl ether (A1) represented by the general formula (I), a component (B) is an amine compound (B1) represented by the general formula (III), a component (C) is a carboxylic acid or a salt thereof selected from the group consisting of an aliphatic carboxylic acid of 4 to 12 carbon atoms or a salt thereof and an aromatic carboxylic acid of 7 to 12 carbon atoms or a salt thereof, and a component (D) is at least one alkanol amine compound selected from the group consisting of an amine compound (D1) having a linear alkanol group, represented by the general formula (V) and an amine compound (D2) having a branched alkanol group, represented by the general formula (VI).

In the aspect, the component (C) may be an aliphatic carboxylic acid of 4 to 12 carbon atoms or a salt thereof (C1), and component (D) may be an amine compound (D1) having a group of linear alkanol group, represented by the general formula (V). In case of meeting the above condition, it is preferable for maintaining the pH during cleaning, and for being superior in detergent properties, corrosion inhibition properties, effluent treatment properties, foaming suppressing properties and liquid stability.

The amine compound (D1) having a linear alkanol group may be monoethanolamine, diethanolamine, triethanolamine or mono-n-propanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) may be an aliphatic dicarboxylic acid of 4 to 12 carbon atoms or a salt thereof.

The aliphatic dicarboxylic acid of 4 to 12 carbon atoms or a salt thereof may be octanedioic acid.

In the aspect, the component (C) may be an aliphatic carboxylic acid of 4 to 12 carbon atoms or a salt thereof (C1), and component (D) may be an amine compound (D2) having a branched alkanol group represented by the general formula (VI). In case of meeting the above condition, it is preferable for maintaining the pH during cleaning, and for being superior in detergent properties, corrosion inhibition properties, foaming suppressing properties, and liquid stability and particularly superior in effluent treatment properties.

The amine compound (D2) having a branched alkanol group may be monoisopropanolamine or diisopropanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) is preferably an aliphatic dicarboxylic acid of 4 to 12 carbon atoms or a salt thereof.

The aliphatic dicarboxylic acid of 4 to 12 carbon atoms or a salt thereof may be dodecanedioic acid.

The detergent composition for metal according to the aspect may further contain a sodium metasilicate.

An another aspect of the present invention relates to a detergent composition for metal in which a component (A) is a polyoxyalkylene alkyl ether (A1) represented by the general formula (I), a component (B) is at least one selected from the group consisting of an allyamine-based compound (B6) having the weight-average molecular weight of 5,000 to 50,000 and a polyethyleneimine (B5) having the weight-average molecular weight of 5,000 to 50,000 and represented by the general formula (IV), a component (C) is a carboxylic acid or a salt thereof selected from the group consisting of an aliphatic carboxylic acid of 4 to 12 carbon atoms or a salt thereof and an aromatic carboxylic acid of 7 to 12 carbon atoms or a salt thereof, and a component (D) is at least one alkanol amine compound selected from the group consisting of an amine compound (D1) having a linear alkanol group, represented by the general formula (V) and an amine compound (D2) having a branched alkanol group, represented by the general formula (VI).

The allylamine-based polymer (B6) may be at least one selected from the group consisting of a monoallylamine-based polymer (B2) having a weight-average molecular weight of 5,000 to 50,000 and having a structural unit represented by following the general formula (VII), and a diallylamine-based polymer (B7).

The diallylamine-based polymer (B7) may be a polymethyldiallylamine hydrochloride (B3) having a weight-average molecular weight of 5,000 to 50,000 and having a structural unit represented by the general formula (VIII) or a polydiallyldimethylammonium chloride (B4) having a weight-average molecular weight of 5,000 to 50,000 and having a structural unit represented by the general formula (IX). The component (B) may be the monoallylamine-based polymer (B2) or the polyethyleneimine (B5).

In the aspect, the component (C) may be an aliphatic carboxylic acid of 4 to 12 carbon atoms or a salt thereof (C1), and component (D) may be an amine compound (D1) having a group of linear alkanol group. In case of meeting the above condition, it is preferable for maintaining the pH during cleaning, and for being superior in detergent properties, corrosion inhibition properties, effluent treatment properties, foaming suppressing properties and liquid stability.

The amine compound (D1) having a linear alkanol group may be monoethanolamine, diethanolamine, triethanolamine or mono-n-propanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) may be an aliphatic dicarboxylic acid of 4 to 12 carbon atoms or a salt thereof.

The aliphatic dicarboxylic acid of 4 to 12 carbon atoms or a salt thereof may be octanedioic acid. In the aspect, the component (C) may be an aliphatic carboxylic acid of 4 to 12 carbon atoms or a salt thereof (C1), and component (D) may be an amine compound (D2) having a group of branched alkanol group. In case of meeting the above condition, it is preferable for maintaining the pH during cleaning, and for being superior in detergent properties, corrosion inhibition properties, foaming suppressing properties, and liquid stability, and particularly superior in effluent treatment properties.

The amine compound (D2) having a branched alkanol group may be monoisopropanolamine or diisopropanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) is preferably an aliphatic dicarboxylic acid of 4 to 12 carbon atoms or a salt thereof.

The aliphatic dicarboxylic acid of 4 to 12 carbon atoms or a salt thereof may be dodecanedioic acid.

The detergent composition for metal according to the aspect may further contain a sodium metasilicate.

An another aspect of the present invention relates to a detergent composition for metal in which a component (A) is a polyoxyalkylene alkyl amine (A2) represented by the general formula (II), a component (B) is an amine compound (B1) represented by the general formula (III), a component (C) is a carboxylic acid or a salt thereof selected from the group consisting of an aliphatic carboxylic acid of 4 to 12 carbon atoms or a salt thereof and an aromatic carboxylic acid of 7 to 12 carbon atoms or a salt thereof, and a component (D) is at least one alkanol amine compound selected from the group consisting of an amine compound (D1) having a linear alkanol group represented by the general formula (V) and an amine compound (D2) having a branched alkanol group represented by the general formula (VI).

In the aspect, the component (C) may be an aliphatic carboxylic acid of 4 to 12 carbon atoms or a salt thereof (C1), and component (D) may be an amine compound (D1) having a linear alkanol group. In case of meeting the above condition, it is preferable for maintaining the pH during cleaning, and for being superior in effluent treatment properties and liquid stability, and particularly superior in detergent properties, corrosion inhibition properties and foaming suppressing properties.

The amine compound (D1) having a linear alkanol group may be monoethanolamine, diethanolamine, triethanolamine or mono-n-propanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) may be an aliphatic dicarboxylic acid of 4 to 12 carbon atoms or a salt thereof.

The aliphatic dicarboxylic acid of 4 to 12 carbon atoms or a salt thereof may be dodecanedioic acid. In the aspect, the component (C) may be an aliphatic carboxylic acid of 4 to 12 carbon atoms or a salt thereof (C1), and component (D) may be an amine compound (D2) having a group of branched alkanol group. In case of meeting the above condition, it is preferable for maintaining the pH during cleaning, and for being superior in liquid stability, and particularly superior in detergent properties, corrosion inhibition properties, effluent treatment properties and foaming suppressing properties.

The amine compound (D2) having a branched alkanol group may be monoisopropanolamine or diisopropanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) is preferably an aliphatic dicarboxylic acid of 4 to 12 carbon atoms or a salt thereof.

The aliphatic dicarboxylic acid of 4 to 12 carbon atoms or a salt thereof may be dodecanedioic acid.

The detergent composition for metal according to the aspect may further contain a sodium metasilicate.

An another aspect of the present invention relates to a detergent composition for metal in which a component (A) is a polyoxyalkylene alkyl amine (A2) represented by the general formula (II), a component (B) is at least one component selected from the group consisting of an allyamine-based compound (B6) having the weight-average molecular weight of 5,000 to 50,000 and a polyethyleneimine (B5) having the weight-average molecular weight of 5,000 to 50,000 and represented by the general formula (IV), a component (C) is a carboxylic acid or a salt thereof selected from the group consisting of an aliphatic carboxylic acid of 4 to 12 carbon atoms or a salt thereof and an aromatic carboxylic acid of 7 to 12 carbon atoms or a salt thereof, and a component (D) is at least one alkanol amine compound selected from the group consisting of an amine compound (D1) having a linear alkanol group represented by the general formula (V) and an amine compound (D2) having a branched alkanol group represented by the general formula (VI).

The allylamine-based polymer (B6) may be at least one selected from the group consisting of a monoallylamine-based polymer (B2) having a weight-average molecular weight of 5,000 to 50,000 and having a structural unit represented by following the general formula (VII), and a diallylamine-based polymer (B7).

The diallylamine-based polymer (B7) may be a polymethyldiallylamine hydrochloride (B3) having a weight-average molecular weight of 5,000 to 50,000 and having a structural unit represented by the general formula (VIII) or a polydiallyldimethylammonium chloride (B4) having a weight-average molecular weight of 5,000 to 50,000 and having a structural unit represented by the general formula (IX).

The component (B) may be the monoallylamine-based polymer (B2) or the polyethyleneimine (B5).

In the aspect, the component (C) may be an aliphatic carboxylic acid of 4 to 12 carbon atoms or a salt thereof (C1), and component (D) may be an amine compound (D1) having a group of linear alkanol group. In case of meeting the above condition, it is preferable for maintaining the pH during cleaning, and for being superior in effluent treatment properties and liquid stability, and particularly superior in detergent properties, corrosion inhibition properties, and foaming suppressing properties.

The amine compound (D1) having a linear alkanol group may be monoethanolamine, diethanolamine, triethanolamine or mono-n-propanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) may be an aliphatic dicarboxylic acid of 4 to 12 carbon atoms or a salt thereof.

The aliphatic dicarboxylic acid of 4 to 12 carbon atoms or a salt thereof may be dodecanedioic acid.

In the aspect, the component (C) may be an aliphatic carboxylic acid of 4 to 12 carbon atoms or a salt thereof (C1), and component (D) may be an amine compound (D2) having a group of branched alkanol group. In case of meeting the above condition, it is preferable for maintaining the pH during cleaning, and for being superior in liquid stability, and particularly superior in detergent properties, corrosion inhibition properties, effluent treatment properties and foaming suppressing properties.

The amine compound (D2) having a branched alkanol group may be monoisopropanolamine or diisopropanolamine.

The aliphatic carboxylic acid of 4 to 12 carbon atoms or a salt thereof (C1) may be an aliphatic monocarboxylic acid of 4 to 12 carbon atoms or a salt thereof.

The aliphatic monocarboxylic acid of 4 to 12 carbon atoms or a salt thereof may be octanoic acid or decanoic acid.

The aliphatic carboxylic acid of 4 to 12 carbon atoms or a salt thereof (C1) is preferably an aliphatic dicarboxylic acid of 4 to 12 carbon atoms or a salt thereof.

The aliphatic dicarboxylic acid of 4 to 12 carbon atoms or a salt thereof may be octanedioic acid.

The detergent composition for metal according to the aspect may further contain a sodium metasilicate.

[Component (E): Water]

A detergent composition of the present invention may include water as a component (E). As water, ion-exchanged water is preferred.

[pH]

The pH of the aqueous solution when the detergent composition containing water is diluted to 1% by mass and measured at 25° C. is greater than or equal to 9, and 9 to 11 is preferred. If the pH of the detergent composition is greater than or equal to 9, the detergent properties and corrosion inhibition properties becomes high. If the pH is less than or equal to 11, the handling properties of the detergent composition becomes good.

For adjusting the pH, an inorganic alkali agent or an inorganic acid can be used.

[Alkali Agent]

As the alkali agent, examples include inorganic alkaline agents such as sodium hydroxide and potassium hydroxide. As the acid, examples include inorganic acids such as hydrochloric acid, sulfuric acid and nitric acid, and organic acids such as acetic acid.

These components may be used alone, or a combination of two or more.

[Sodium Silicate]

A detergent composition for metal of the present invention may include sodium silicate. In particular, sodium metasilicate is preferred. Sodium metasilicate exhibits corrosion inhibition properties. In the case of cleaning the aluminum, sodium metasilicate exhibits favorable corrosion inhibition properties.

In the first to fourth aspects of the present invention, the amount of sodium metasilicate is preferably 0.5 to 3% by mass, more preferably 0.8 to 2% by mass, and further preferably 1 to 1.5% by mass, when the entire detergent composition is 100% by mass.

[Amount of Component (A), Component (B), Component (C) and Component (D)]

In the detergent composition for metal in the first to fourth aspects of the present invention, the total amount of the amount of the component (A), the component (B), the component (C) and the component (D) is greater than or equal to 20% by mass, preferably 26 to 90% by mass, more preferably 36 to 80% by mass, and particularly preferably 64 to 72% by mass, relative to the total amount of the detergent composition as high as 100% by mass. In addition, if the amount is greater than or equal to 50% by mass, the used amount of detergent composition and the cost of distribution can be reduced, because the detergent composition can use as a concentrated detergent composition. As a concentrated detergent composition, 50 to 90% by mass is preferable, 60 to 80% by mass is more preferable, and 64 to 72% by mass is particularly preferable.

It is noted that component other than the components (A), (B), (C) and (D) is mostly water (component E). Of course, an appropriate amount of optional ingredient can be added.

It is noted that a concentrated detergent composition for metal in the present specification means a detergent composition for metal in which the total amount of the component (A), the component (B), the component (C) and the component (D) is greater than or equal to 50% by mass, relative to the total amount of the detergent composition.

[Content Ratio of Components]

In the first to fourth aspects of the present invention, the value {(the amount of the component (A))+(the amount of the component (B))}/{(the amount of the component (C))+(the amount of the component (D))} is preferably less than or equal to 0.6, more preferably 0.1 to 0.5, an further preferably 0.2 to 0.4, in order to provide a concentrated detergent composition having excellent liquid stability. If the value is less than or equal to 0.6, the liquid stability can be maintained. Further, even if the detergent composition is diluted with water, uniform and transparent diluted solution can be immediately prepared without clouding. If the value is greater than 0.6, the liquid stability is reduced.

[Other Components]

In addition, the detergent agent of the present invention may also contain antifoaming agents, preservative agents and chelating agents as optional components.

[Antifoaming Agent]

As a defoaming agent, examples include a hydrocarbon of 12 or more carbon atoms, a higher alcohol and a silicone. In particular, tridecanol is preferred. The amount of defoaming agent is preferably 0.1 to 8% by mass, more preferably 0.5 to 5% by mass, and further preferably 1 to 3% by mass, when the entire detergent composition is 100% by mass. If the amount of antifoaming agent is greater than or equal to 0.1% by mass, defoaming can be sufficiently conducted. If the amount of antifoaming agent is less than or equal to 8% by mass, liquid stability can be improved.

[Preservative Agent]

As a preservative agent, examples include methylisothiazolinone, benzisothiazolinone, and 3-iodo-2-propynylbutylcarbamate. The amount of preservative agent is preferably 0.01 to 0.3% by mass, more preferably 0.05 to 0.2% by mass, and further preferably 0.1 to 0.2% by mass, when the entire detergent composition is 100% by mass. If the amount of preservative agent is greater than or equal to 0.01% by mass, preservative properties can be sufficiently exhibited. If the amount of preservative agent is less than or equal to 0.3% by mass, the cost can be reduced.

[Chelating Agent]

As a chelating agent, examples include amino-carboxylic acid-based chelating agents such as ethylenediaminetetraacetic acid (EDTA), nitrilotriacetic acid (NTA), methylglycinediacetic acid (MGDA), and organic phosphonic acid-based chelating agents such as 1-hydroxyethylidene-1,1-diphosphonic acid (HEDP).

[Dilution of Detergent Composition]

Detergent composition may be appropriately diluted prior to use depending on the object of the washing.

If the objects for cleaning are metal parts for automobiles, the composition can be preferably diluted to 0.3 to 15% by mass, and more preferably diluted to 0.5 to 5.0% by mass. If the dilute concentration is greater than or equal to 0.3% by mass, sufficient detergency, corrosion inhibition properties and foaming suppressing properties can be obtained. If the dilute concentration is greater than 15% by mass, the concentration is too high, and used amount of the detergent composition becomes more than necessary amount for cleaning.

As a solvent for dilution, water is preferred because of the excellent handling.

[Production Method]

A production method of detergent composition is not particularly limited and can be appropriately selected depending on the purpose. For example, the detergent composition can be produced by mixing the component (A), component (B), component (C), component (D), and if necessary other components and solvents. More specifically, for example, the component (A), component (B), component (C), component (D) and the other components as necessary are added in a solvent, stirred at 10 to 30° C., and then the detergent composition can be produced. An equipment used for stirring is also not particularly limited, and can be appropriately selected depending on the purpose. For example, a stirring blade or agitating blade can be used.

A solvent for dilution is not particularly limited and can be appropriately selected depending on the purpose. Water is preferred because of the excellent handling ability.

[Function Effect]

As mentioned above, the detergent composition containing the four components (A) to (D) in the above range, and having the pH of at least 9 when the detergent is diluted to 1% by mass aqueous solution and measured at 25° C., has high detergent properties for metal, and excellent corrosion inhibition properties, excellent foaming suppressing properties and excellent liquid stability.

In addition, the detergent composition of the present invention has low foaming in spray cleaning, and is excellent in detergent properties, corrosion inhibition properties, excellent effluent treatment properties, and liquid stability even in the concentrated detergent. The detergent composition of the present invention is particularly excellent in detergency for cutting debris or cutting oil. Thus, the detergent composition is preferably used for cleaning of metal parts for automobiles to which cutting debris and cutting oil are frequently adhered.

EXAMPLES

The component (A) (nonionic surfactant), the component (B) (amine compound), the component (C) (carboxylic acid) and the component (D) (alkanolamine compound) used in Examples and Comparative Examples are shown in Table 1. In the Table 1, "C12 to 14" represents the number of carbon atoms of secondary alkyl group. Each of integer that is recited after "EO=" or "PO=" means average addition mole number of EO or average addition mole number of PO.

TABLE 1

| Component | No. | Compound name | Manufacturer, model number |
|---|---|---|---|
| Component (A) | A-1 | Polyoxyethylene mono-2-ethylhexyl ether | Newcall 1004, manufactured by Nippon Nyukazai Co., Ltd. |

TABLE 1-continued

| Component | No. | Compound name | Manufacturer, model number |
|---|---|---|---|
| | A-2 | Polyoxyethylene decyl ether (EO = 4) | NOIGEN XL-40 manufactured by Dai-Ichi Kogyo Seiyaku Co., Ltd. |
| | A-3 | Polyoxyethylene decyl ether (EO = 6) | NOIGEN XL-60 manufactured by Dai-Ichi Kogyo Seiyaku Co., Ltd. |
| | A-4 | Polyoxyethylene polypropylene decyl ether (EO = 6, PO = 2) | obtained by block addition of 2 mol of PO to NOIGEN XL-60 manufactured by Dai-Ichi Kogyo Seiyaku Co., Ltd. in the presence of an alkali catalyst |
| | A-5 Comparative component | Hexyldiglycol | manufactured by Nippon Nyukazai Co., Ltd. |
| | A-6 Comparative component | Polyoxyethylene sec-alkylether (C12 to 14, EO = 5) | LEOCOL SC-50 manufactured by Lion Co., Ltd. |
| | A-7 Comparative component | Polyoxyethylene dodecylamine (EO = 2) | Esomin C/12 manufactured by Lion Akzo Co., Ltd. |
| | A-8 | Polyoxyethylene dodecylamine (EO = 5) | Esomin C/15 manufactured by Lion Akzo Co., Ltd. |
| | A-9 | Polyoxyethylene octadecylamine (EO = 5) | Esomin T/15 manufactured by Lion Akzo Co., Ltd. |
| | A-10 | Polyoxyethylene octadecylamine (EO = 10) | Esomin T/20 manufactured by LION AKZO Co., Ltd. |
| | A-11 Comparative component | Polyoxyethylene octadecylamine (EO = 15) | Esomin T/25 manufactured by Lion Akzo Co., Ltd. |
| Component (B) | B-1 | Alkyl oxo amine | Amine M14 manufactured by Nof Co., Ltd. |
| | B-2 | Alkyldiamine | Duomine CD manufactured by Lion Akzo Co., Ltd. |
| | B-3 | Polyethyleneimine | EPOMIN SP-200 manufactured by NIPPON Shokubai Co., Ltd. |
| | B-4 | Polyallylamine | PAA-15C manufactured by Nitto Boseki Co., Ltd. |
| | B-5 | Polymethyldiallylamine hydrochloride | PAS-M1 manufactured by Nitto Boseki Co., Ltd. |
| | B-6 | Polydiallyldimethyammonium chloride | PAS-H5L manufactured by Nitto Boseki Co., Ltd. |
| Component (C) | C-1 | n-Octanoic acid | Kanto Chemical Co., Ltd. |
| | C-2 | n-Decanoic acid | Kanto Chemical Co., Ltd. |
| | C-3 | Dodecanedioic acid | UBE INDUSTRIES Co., Ltd. |
| Component (D) | D-1 | Monoisopropanolamine | Kanto Chemical Co., Ltd. |
| | D-2 | Diisopropanolamine | Kanto Chemical Co., Ltd. |
| | D-3 | Monoethanolamine | Kanto Chemical Co., Ltd. |
| | D-4 | Diethanolamine | Kanto Chemical Co., Ltd. |
| | D-5 | Mono n-propanolamine | Kanto Chemical Co., Ltd. |

Examples 1 to 32, and Comparative Examples 1 to 9

Each of detergent composition was prepared by mixing each component in the ratio shown in Tables 2, 3 and 4. In addition, the units of the amount shown in Tables 2, 3 and 4 of is "% by mass", indicating the amount of equivalent purity of any component. pH shows the pH when the detergent composition containing water was diluted to 1% by mass aqueous solution and then measured at 25° C. Ph was adjusted by adding aqueous sodium hydroxide as an alkaline agent or inorganic acids such as sulfuric acid as the acid, if necessary. In addition, in the tables, "balance" in the amount of water means that the water was added so that total amount of all components becomes 100% by mass.

Detergent properties, corrosion inhibition properties, effluent treatment properties, foaming suppressing properties and liquid stability of the resulting detergent composition were evaluated as follows.

TABLE 2

| | | Examples | | | | | | | |
|---|---|---|---|---|---|---|---|---|---|
| | | 1 | 2 | 3 | 4 | 5 | 6 | 7 | 8 |
| Component (A) | A-1 | 15 | | | | | | | |
| | A-2 | | 15 | | | 15 | 15 | 15 | 7.5 |
| | A-3 | | | 15 | | | | | |
| | A-4 | | | | 15 | | | | |
| | A-5(Comparative component) | | | | | | | | |
| | A-6(Comparative component) | | | | | | | | |

TABLE 2-continued

| | | | | | | | | | |
|---|---|---|---|---|---|---|---|---|---|
| | A-7(Comparative component) | | | | | | | | |
| | A-8 | | | | | | | | |
| | A-9 | | | | | | | | |
| Component (B) | B-1 | 5 | 5 | 5 | 5 | | 5 | 5 | 2.5 |
| | B-2 | | | | | 5 | | | |
| | B-3 | | | | | | | | |
| | B-4 | | | | | | | | |
| | B-5 | | | | | | | | |
| | B-6 | | | | | | | | |
| Component (C) | C-1 | 20 | 20 | 20 | 20 | 20 | | 20 | 10 |
| | C-2 | | | | | | 20 | | |
| | C-3 | | | | | | | | |
| Component (D) | D-1 | 32 | 32 | 32 | 32 | 32 | 32 | | 16 |
| | D-2 | | | | | | | 32 | |
| | D-3 | | | | | | | | |
| | D-4 | | | | | | | | |
| | D-5 | | | | | | | | |
| Alkali agent | sodium hydroxyde | | | | | | | | |
| | sodium metasilicate | | | | | | | | |
| Component (E) | water | valance | valance | valance | valance | valance | valance | valance | valance |
| Common component | tridecanol | 3 | 3 | 3 | 3 | 3 | 3 | 3 | 3 |
| | preservative agent | 0.3 | 0.3 | 0.3 | 0.3 | 0.3 | 0.3 | 0.3 | 0.3 |
| pH | | 10 | 10 | 10 | 10 | 10 | 10 | 10 | 10 |
| (A) + (B) + (C) + (D) | | 72 | 72 | 72 | 72 | 72 | 72 | 72 | — |
| [(A) + (B)]/[(C) + (D)] | | 0.38 | 0.38 | 0.38 | 0.38 | 0.38 | 0.38 | 0.38 | — |
| Detergent property | | 3 | 4 | 5 | 3 | 4 | 4 | 4 | 3 |
| Corrosion inhibition property (Iron) | | 4 | 4 | 4 | 4 | 4 | 5 | 4 | 3 |
| Corrosion inhibition property (Aluminum) | | 4 | 4 | 4 | 4 | 4 | 4 | 4 | 4 |
| Effluent treatment property (ppm) | | 900 | 900 | 900 | 900 | 900 | 900 | 950 | 700 |
| Foaming suppressing property (mm) | | 3 | 5 | 7 | 2 | 7 | 4 | 5 | 2 |
| Liquid stability | | A | A | A | A | A | A | A | — |

| | | Examples | | | | | | | |
|---|---|---|---|---|---|---|---|---|---|
| | | 9 | 10 | 11 | 12 | 13 | 14 | 15 | 16 |
| Component (A) | A-1 | | | | | | | | |
| | A-2 | 15 | 15 | 15 | 15 | 15 | 15 | 15 | 15 |
| | A-3 | | | | | | | | |
| | A-4 | | | | | | | | |
| | A-5(Comparative component) | | | | | | | | |
| | A-6(Comparative component) | | | | | | | | |
| | A-7(Comparative component) | | | | | | | | |
| | A-8 | | | | | | | | |
| | A-9 | | | | | | | | |
| Component (B) | B-1 | | | | | 5 | | 5 | 5 |
| | B-2 | | | | | | | | |
| | B-3 | 5 | | | | | | | |
| | B-4 | | 5 | | | | | | |
| | B-5 | | | 5 | | | | | |
| | B-6 | | | | 5 | | | | |
| Component (C) | C-1 | 20 | 20 | 20 | 20 | | | 20 | 20 |
| | C-2 | | | | | | | | |
| | C-3 | | | | | 20 | 20 | | |
| Component (D) | D-1 | 32 | 32 | 32 | 32 | 32 | 32 | | |
| | D-2 | | | | | | | | |
| | D-3 | | | | | | | | |
| | D-4 | | | | | | | 32 | |
| | D-5 | | | | | | | | 32 |
| Alkali agent | sodium hydroxyde | | | | | | | | |
| | sodium metasilicate | | | | | | | | |
| Component (E) | water | valance | valance | valance | valance | valance | valance | valance | valance |
| Common component | tridecanol | 3 | 3 | 3 | 3 | 3 | 3 | 3 | 3 |
| | preservative agent | 0.3 | 0.3 | 0.3 | 0.3 | 0.3 | 0.3 | 0.3 | 0.3 |
| pH | | 10 | 10 | 10 | 10 | 10 | 10 | 10 | 10 |
| (A) + (B) + (C) + (D) | | 72 | 72 | 72 | 72 | 72 | 72 | 72 | 72 |
| [(A) + (B)]/[(C) + (D)] | | 0.38 | 0.38 | 0.38 | 0.38 | 0.38 | 0.38 | 0.38 | 0.38 |
| Detergent property | | 4 | 4 | 4 | 4 | 4 | 4 | 4 | 4 |
| Corrosion inhibition property (Iron) | | 4 | 4 | 4 | 4 | 5 | 5 | 4 | 4 |
| Corrosion inhibition property (Aluminum) | | 4 | 4 | 4 | 4 | 4 | 4 | 4 | 4 |
| Effluent treatment property (ppm) | | 900 | 900 | 900 | 900 | 900 | 900 | 1700 | 1300 |
| Foaming suppressing property (mm) | | 3 | 3 | 3 | 3 | 3 | 3 | 5 | 5 |
| Liquid stability | | A | A | A | A | A | A | A | A |

Unit of the amount of each component is "% by mass".

TABLE 3

| | | Examples | | | | | | | |
|---|---|---|---|---|---|---|---|---|---|
| | | 17 | 18 | 19 | 20 | 21 | 22 | 23 | 24 |
| Component (A) | A-1 | | | | | | | | |
| | A-2 | | | | | | | | |
| | A-3 | | | | | | | | |
| | A-4 | | | | | | | | |
| | A-5(Comparative component) | | | | | | | | |
| | A-6(Comparative component) | | | | | | | | |
| | A-7(Comparative component) | | | | | | | | |
| | A-8 | | | | | | | | |
| | A-9 | 5 | 7 | 7 | 7 | 7 | 7 | 7 | 7 |
| | A-10 | | | | | | | | |
| | A-11(Comparative component) | | | | | | | | |
| Component (B) | B-1 | | 5 | 5 | | | | | |
| | B-2 | | | | 5 | | | | |
| | B-3 | | | | | | | 5 | |
| | B-4 | 3 | | | | | | | 5 |
| | B-5 | | | | | 5 | | | |
| | B-6 | | | | | | 5 | | |
| Component (C) | C-1 | 16 | 20 | 20 | 20 | 20 | 20 | 20 | 20 |
| | C-2 | | | | | | | | |
| | C-3 | | | | | | | | |
| Component (D) | D-1 | 2 | 32 | | 32 | 32 | 32 | 32 | 32 |
| | D-2 | | | 32 | | | | | |
| | D-3 | | | | | | | | |
| | D-4 | | | | | | | | |
| | D-5 | | | | | | | | |
| Alkali agent | sodium hydroxyde | 3 | | | | | | | |
| | sodium metasilicate | 1.02 | | | | | | | |
| Component (E) | water | valance | valance | valance | valance | valance | valance | valance | valance |
| Common component | tridecanol | 4 | 1.7 | 1.7 | 1.7 | 1.7 | 1.7 | 1.7 | 1.7 |
| | preservative agent | 0.3 | 0.3 | 0.3 | 0.3 | 0.3 | 0.3 | 0.3 | 0.3 |
| pH | | 10 | 10 | 10 | 10 | 10 | 10 | 10 | 10 |
| (A) + (B) + (C) + (D) | | — | 64 | 64 | 64 | 64 | 64 | 64 | 64 |
| [(A) + (B)]/[(C) + (D)] | | — | 0.23 | 0.23 | 0.23 | 0.23 | 0.23 | 0.23 | 0.23 |
| Detergent property | | 4 | 5 | 5 | 5 | 5 | 5 | 5 | 5 |
| Corrosion inhibition property (Iron) | | 3 | 4 | 4 | 4 | 4 | 4 | 4 | 4 |
| Corrosion inhibition property (Aluminum) | | 5 | 4 | 4 | 4 | 4 | 4 | 4 | 4 |
| Effluent treatment property (ppm) | | 400 | 700 | 750 | 700 | 700 | 700 | 700 | 700 |
| Foaming suppressing property (mm) | | 3 | 4 | 4 | 5 | 1.5 | 1.5 | 1.5 | 1.5 |
| Liquid stability | | — | A | A | A | A | A | A | A |

| | | Examples | | | | | | | |
|---|---|---|---|---|---|---|---|---|---|
| | | 25 | 26 | 27 | 28 | 29 | 30 | 31 | 32 |
| Component (A) | A-1 | | | | | | | | |
| | A-2 | | | | | | | | |
| | A-3 | | | | | | | | |
| | A-4 | | | | | | | | |
| | A-5(Comparative component) | | | | | | | | |
| | A-6(Comparative component) | | | | | | | | |
| | A-7(Comparative component) | | | | | | | | |
| | A-8 | | | 7 | | | | | |
| | A-9 | 7 | | | 7 | 7 | 7 | 7 | 5 |
| | A-10 | | 7 | | | | | | |
| | A-11(Comparative component) | | | | | | | | |
| Component (B) | B-1 | | | | | | 5 | | |
| | B-2 | | | | | | | | |
| | B-3 | | | | | | | | |
| | B-4 | 5 | 5 | 5 | 5 | 5 | | 5 | 3 |
| | B-5 | | | | | | | | |
| | B-6 | | | | | | | | |
| Component (C) | C-1 | | 20 | 20 | 20 | | 20 | 2 | 16 |
| | C-2 | 20 | | | | | | | |
| | C-3 | | | | | 20 | | 18 | |
| Component (D) | D-1 | 32 | 32 | 32 | | 32 | | 32 | 2 |
| | D-2 | | | | | | | | |
| | D-3 | | | | 32 | | | | |

TABLE 3-continued

| | | | | | | | | | |
|---|---|---|---|---|---|---|---|---|---|
| | D-4 | | | | | | 32 | | |
| | D-5 | | | | | | | | |
| Alkali agent | sodium hydroxyde | | | | | | | | 4 |
| | sodium metasilicate | | | | | | | | |
| Component (E) | water | valance | valance | valance | valance | valance | valance | valance | valance |
| Common component | tridecanol | 1.7 | 1.7 | 1.7 | 1.7 | 1.7 | 1.7 | 1.7 | 4 |
| | preservative agent | 0.3 | 0.3 | 0.3 | 0.3 | 0.3 | 0.3 | 0.3 | 0.3 |
| pH | | 10 | 10 | 10 | 10 | 10 | 10 | 10 | 10 |
| (A) + (B) + (C) + (D) | | 64 | 64 | 64 | 64 | 64 | 64 | 64 | — |
| [(A) + (B)]/[(C) + (D)] | | 0.23 | 0.23 | 0.23 | 0.23 | 0.23 | 0.23 | 0.23 | — |
| Detergent property | | 5 | 5 | 5 | 5 | 5 | 5 | 5 | 4 |
| Corrosion inhibition property (Iron) | | 4 | 4 | 4 | 4 | 5 | 4 | 5 | 3 |
| Corrosion inhibition property (Aluminum) | | 4 | 4 | 4 | 4 | 4 | 4 | 4 | 4 |
| Effluent treatment property (ppm) | | 700 | 700 | 700 | 1100 | 700 | 1200 | 700 | 400 |
| Foaming suppressing property (mm) | | 1.5 | 6 | 3 | 1.5 | 1.5 | 1.5 | 1.5 | 3 |
| Liquid stability | | A | A | A | A | A | A | A | — |

Unit of the amount of each component is "% by mass".

TABLE 4

| | | Comparative Examples | | | | | | | | |
|---|---|---|---|---|---|---|---|---|---|---|
| | | 1 | 2 | 3 | 4 | 5 | 6 | 7 | 8 | 9 |
| Component (A) | A-1 | | | | | | | | | |
| | A-2 | | | | 15 | 15 | 15 | 15 | | |
| | A-3 | | | | | | | | | |
| | A-4 | | | | | | | | | |
| | A-5(Comparative component) | | 15 | | | | | | | |
| | A-6(Comparative component) | | | 15 | | | | | | |
| | A-7(Comparative component) | | | | | | | | 7 | |
| | A-8 | | | | | | | | | |
| | A-9 | | | | | | | | | |
| | A-10 | | | | | | | | | |
| | A-11(Comparative component) | | | | | | | | | 7 |
| Component (B) | B-1 | 5 | 5 | 5 | | 5 | 5 | 5 | 5 | |
| | B-2 | | | | | | | | | |
| | B-3 | | | | | | | | | |
| | B-4 | | | | | | | | | 5 |
| Component (C) | C-1 | 20 | 20 | 20 | 20 | | 20 | 20 | 10 | 20 |
| | C-2 | | | | | | | | | |
| | C-3 | | | | | | | | 10 | |
| Component (D) | D-1 | 32 | 32 | 32 | 32 | 32 | | 32 | 32 | 32 |
| | D-2 | | | | | | | | | |
| | D-3 | | | | | | | | | |
| | D-4 | | | | | | | | | |
| | D-5 | | | | | | | | | |
| Alkali agent | sodium hydroxyde | | | | appropriate amount | | appropriate amount | | | |
| | hydrochloric acid | | | | | appropriate amount | | appropriate amount | | |
| | sodium metasilicate | | | | | | | | | |
| Component (E) | water | valance | valance | valance | valance | valance | valance | valance | valance | valance |
| Common component | tridecanol | 3 | 3 | 3 | 3 | 3 | 3 | 3 | 3 | 1.7 |
| | preservative agent | 0.3 | 0.3 | 0.3 | 0.3 | 0.3 | 0.3 | 0.3 | 0.3 | 0.3 |
| pH | | 10 | 10 | 10 | 10 | 10 | 10 | 7 | 10 | 10 |
| (A) + (B) + (C) + (D) | | 57 | 72 | 72 | 67 | 52 | 40 | 72 | 64 | 64 |
| [(A) + (B)]/[(C) + (D)] | | 0.1 | 0.38 | 0.38 | 0.29 | 0.63 | 1.00 | 0.38 | 0.23 | 0.23 |
| Detergent property | | 1 | 2 | 2 | 4 | 4 | 4 | 2 | 2 | 5 |
| Corrosion inhibition property (Iron) | | 4 | 4 | 4 | 2 | 1 | 2 | 1 | 4 | 4 |
| Corrosion inhibition property (Aluminum) | | 4 | 4 | 4 | 4 | 4 | 4 | 4 | 4 | 4 |
| Effluent treatment property (ppm) | | 900 | 900 | 900 | 900 | 900 | 900 | 900 | 700 | 700 |
| Foaming suppressing property (mm) | | 2 | 2 | 8 | 10 | 5 | 3 | 5 | 3 | 10 |
| Liquid stability | | A | A | A | A | C | — | B | A | A |

Unit of the amount of each component is "% by mass".

<Detergent Property>

(Test Method)

0.5 ml of the water-soluble cutting oil (Synthetic #770, manufactured by Yushiro Chemical Industry Co., Ltd.) was applied uniformly on an iron test piece (2.5 cm×7.5 cm, JIS G 3131 SPCC, manufactured by TP GIKEN Co., Ltd.). Next, 0.1 g of iron powders having an average particle diameter of 100 to 200 μm were applied on the coated surface, and heated at 100° C. for 2 hours, thereby obtaining a dirty plate. Next, the test piece of dirty plate cooled to room temperature was immersed for 1 minute in 80 ml of detergent solution diluted to 1% by mass.

Then the test piece was picked up from the detergent solution, and the amount of iron powder residue on the test piece was visually observed, and the residue was evaluated according to the following criteria.

5 . . . Iron powder was not at all observed.

4 . . . Iron powder was not almost observed.

3 . . . Several iron powder was left.

2 . . . Dozens of iron powder was left.

1 . . . Hundreds of iron powder was left.

It is noted that if it was 3 or more, the detergent composition had a practical detergency.

<Corrosion Inhibition Property>

Corrosion Inhibition Property for Iron (Test Method)

The filter paper was placed in a petri dish, 0.3 mg of iron powders having an average particle diameter of 100 to 200 μm was uniformly placed onto the filter paper, 2 g of detergent solution diluted to 1% by mass was added dropwise, and was allowed to stand for one day under the environment of 40° C. in a closed state. Then the state of iron rust was visually observed and evaluated by the following criteria.

5 . . . Rust was not at all observed.

4 . . . Very slight rust was observed.

3 . . . A little rust was observed.

2 . . . Rust was observed.

1 . . . Considerable rust was observed.

It is noted that if it was 3 or more, the detergent composition had a practical corrosion inhibition properties.

Corrosion Inhibition Property for Aluminum (Test Method)

Aluminum test piece (ADC-12, manufactured by TP GIKEN Co., Ltd., trade name: A2017P, 20 mm×70 mm×0.5 mm) was immersed for 10 minutes at 50° C. in 100 mL of detergent solution diluted to 1% by mass, and the appearance of test piece after the immersion was evaluated by the following criteria.

5 . . . Rust was not at all observed.

4 . . . Very slight rust was observed.

3 . . . A little rust was observed.

2 . . . Rust was observed.

1 . . . Considerable rust was observed.

It is noted that if it was 3 or more, the detergent composition had a practical corrosion inhibition properties.

<Effluent Treatment Property>: According to JISK0102, Standard Number of 17

(1) Coagulation Treatment 10 mL of sulfuric acid band ($Al_2O_3$, 8% by mass) was added to 500 mL of the detergent solution diluted to 1% by mass, then the pH was adjusted to pH 7 using sodium hydroxide (NaOH) while stirring. Next, weaken the agitation, 2 mL of polymer flocculant (manufactured by Kurita Water Industries Ltd., trade name: Cliff Rock, 0.1% by mass) was added thereto and then stirred for 15 minutes in order to conduct coagulation treatment. After standing for 15 minutes, the resulting agglomerate was removed by filtration, and then filtrate was obtained.

(2) Measurement of COD (Chemical Oxygen Demand)

The COD of filtrate was evaluated by the following criteria.

[Reagents]

Sulfuric acid (1+2) (Sulfuric acid diluted with 2 times the volume of water)

Solution of silver nitrate (200 g/L)

Potassium permaganate (5 mM)

Sodium oxalate (12.5 mM)

[Measurement]

1 g of filtrate was weighed and diluted with purified water to 100 g (300 mL of erlenmeyer flask was used). Next, 10 mL of sulfuric acid, 5 mL of solution of silver nitrate and 10 mL of potassium permanganate were added to the diluted filtrate, and heated in a boiling water bath for 30 minutes. Subsequently, 10 mL of sodium oxalate was added thereto to decolorize, and titrated with potassium permanganate. Then, COD was calculated using the following formula.

$$COD_{Mn}(mgO/L)=(\text{titer of sample (mL)}-\text{titer of blank (mL)})\times\text{factor}\times1000/\text{amount of sample (g)}\times0.2$$

[Decision Criteria]

If $COD_{Mn}$ was less than or equal to 1800, the detergent composition had a practical effluent treatment properties <Foaming Suppressing Property>

(Test Method)

A mixed solution of 30 mL of a detergent solution diluted to 1% by mass with 3 mL of a water-soluble cutting oil (manufactured by Yushiro Chemical Industry Co., Ltd., product name: Yushiroken GTS-100) was added to a color comparison tube (2.8 cm of diameter×25 cm of height), and foamed by shaking 30 times. The foam height (mm) was measured immediately after foaming.

It was noted that if it was less than or equal to 7 mm, the detergent composition had a practical foaming suppressing properties.

<Liquid Stability>

(Test Method)

Each of detergent composition prepared by mixing each component in the ratio shown in Tables 2, 3 and 4 was stored at −5° C., and liquid stability was evaluated. The state of the detergent composition was visually observed and evaluated by the following criteria.

A . . . uniform and transparent liquid was observed.

B . . . cloudiness was observed, however transparency was recovered after standing at 25° C.

C . . . cloudiness and separation was observed, and transparency could not be recovered after standing at 25° C.

D . . . solidification was observed, and transparency could not be recovered after standing at 25° C.

It was noted that if transparency could be recovered, the detergent composition was determined as a practical one.

<pH Measurement>

Each of detergent composition prepared by mixing water in the ratio shown in Tables 2, 3 was diluted to 1% by mass of aqueous solution, and the pH of the solution was measured using pH meter manufactured by Horiba Co., Ltd., product name D-21.

The detergent compositions of Examples 1 to 16 using polyoxyalkylene alkyl ether having $R^1$ of 8 to 10 carbon atoms in general formula (I) as component (A) exhibited excellent detergency, corrosion inhibition properties for iron and corrosion properties for aluminum.

The detergent compositions of Examples 17 to 32 using polyoxyalkylene alkyl amine represented by general formula (II) as component (A) exhibited more excellent detergency, corrosion inhibition properties for iron and corrosion properties for aluminum. The detergent compositions of Examples 17, 21 to 29, 31 and 32 using a combination of the above component (A) with a polyethyleneimine, polyallylamine, polymethyldiallylamine hydrochloride or polydiallyldimethyammonium chloride as component (B) exhibited particularly excellent foaming suppressing properties.

The detergent compositions of Examples 13, 14, 29 and 31 using an aliphatic dicarboxylic acid as component (C) exhibited particularly excellent corrosion inhibition properties for iron.

The detergent compositions of Examples 1 to 14, 17 to 27, 29, 31 and 32 using an amine compound having a branched alkanol group as component (D) were superior in effluent treatment properties as compared to the detergent compositions of Examples 15, 16, 28 and 30 using an amine compound having a linear alkanol group represented by the general formula (V). In particular, the detergent compositions of Examples 17 to 27, 29, 31 and 32 using a polyoxyalkylene alkyl amine represented by general formula (II) as component (A) were superior in effluent treatment properties as compared to the detergent compositions of Examples 1 to 14 using polyoxyalkylene alkyl ether having $R^1$ of 8 to 11 carbon atoms in general formula (I).

The concentrated detergent compositions of Examples 1 to 7, 9 to 16 and 18 to 31, in which the total amount of the amount of the component (A), the component (B), the component (C) and the component (D) was greater than or equal to 50% by mass, relative to the total amount of the detergent composition as high as 100% by mass, and which was fulfilled the following formula {(the amount of the component (A))+(the amount of the component (B))}/{(the amount of the component (C))+(the amount of the component (D))}≤0.6, exhibited excellent liquid stability.

The detergent composition of Example 17 had particularly excellent corrosion inhibition properties for aluminum.

In contrast, the detergent composition of Comparative Example 1 not containing a component (A) but containing an amine compound, aliphatic carboxylic acid and amine compound having a branched alkanolamine group compounds exhibited low detergent properties.

The detergent composition of Comparative Example 2 containing an amine compound, an aliphatic carboxylic acid, and an amine compound having a branched alkanolamine group and using a polyoxyalkylene alkyl ether having $R^1$ of less than 8 carbon atoms in general formula (I) exhibited low detergent properties.

The detergent composition of Comparative Example 3 containing an amine compound, an aliphatic carboxylic acid, and an amine compound having a branched alkanolamine group and using a polyoxyalkylene alkyl ether having $R^1$ of greater than 11 carbon atoms in general formula (I) exhibited low detergent properties and low foaming suppressing properties.

The detergent composition of Comparative Example 4 not containing a component (B) but containing a polyoxyalkylene alkyl ether having $R^1$ of 8 to 11 carbon atoms in general formula (I), an aliphatic carboxylic acid and an amine compound having a branched alkanolamine group compounds exhibited low corrosion properties for iron and low foaming suppressing properties.

The detergent composition of Comparative Example 5 not containing a component (C) but containing a polyoxyalkylene alkyl ether having $R^1$ of 8 to 11 carbon atoms in general formula (I), an amine compound and an amine compound having a branched alkanolamine group compounds exhibited low corrosion properties for iron.

The detergent composition of Comparative Example 6 not containing a component (D) but containing a polyoxyalkylene alkyl ether having $R^1$ of 8 to 11 carbon atoms in general formula (I), an amine compound and an aliphatic carboxylic acid exhibited low corrosion properties for iron.

The detergent composition of Comparative Example 7 having the pH of less than 10 exhibited low detergent properties and low corrosion inhibition properties.

The detergent composition of Comparative Example 8 containing an amine compound, an aliphatic carboxylic acid, and an amine compound having a branched alkanolamine group, but using a polyoxyalkylene alkyl amine in which the average addition mole number of ethyleneoxy group was 2 exhibited low detergency.

The detergent composition of Comparative Example 8 containing an amine compound, an aliphatic carboxylic acid, and an amine compound having a branched alkanolamine group, but using a polyoxyalkylene alkyl amine in which the average addition mole number of ethyleneoxy group was 15 exhibited low detergency.

The concentrated type detergent compositions of Comparative Example 5, in which the total amount of the amount of the component (A), the component (B), the component (C) and the component (D) was greater than or equal to 50% by mass, relative to the total amount of the detergent composition as high as 100% by mass, but which was not fulfilled the following formula {(the amount of the component (A))+(the amount of the component (B))}/{(the amount of the component (C))+(the amount of the component (D))}≤0.6, exhibited low liquid stability.

INDUSTRIAL APPLICABILITY

The detergent composition for metal of the present invention exhibits excellent corrosion inhibition properties, excellent effluent treatment properties, excellent foaming suppressing properties and excellent liquid stability in addition to high detergent properties for metal.

Furthermore, the detergent composition for metal of the present invention also exhibits foaming suppressing properties in spray cleaning, excellent detergent properties, excellent corrosion inhibition properties, excellent effluent treatment properties and excellent liquid stability even of the concentrated detergent composition.

The invention claimed is:

1. A detergent composition for metal comprising a component (A), a component (B), a component (C) and a component (D) as described below, and having a pH of at least 9 that is measured at 25° C. when the detergent composition is diluted to 1% by mass of an aqueous solution;

a component (A): a polyoxyalkylene alkyl ether (A1) represented by general formula (I);

[Chemical Formula 1]

$$R^1O(EO)_{n1}(PO)_{m1}H \quad (I)$$

wherein $R^1$ represents an alkyl group of 8 to 11 of carbon atoms or an alkenyl group of 8 to 11 of carbon atoms; EO represents an ethyleneoxy group; PO represents a propyleneoxy group; n1 represents an average addition mole number of EO and is an integer of 1 to 10; m1 represents an average addition mole number of PO and is an integer of 0 to 5;

a component (B): a nitrogen-containing organic compound of at least one selected from the group consisting of an amine compound (B1) represented by general formula (III), an allylamine-based polymer (B6) having a weight-average molecular weight of 5,000 to 50,000 and a polyethylene imine (B5) having a weight-average molecular weight of 5,000 to 50,000 and having a structural unit represented by general formula (IV);

[Chemical Formula 3]

$$R^2—Z—(CH_2)_3—NH_2 \quad (III)$$

wherein $R^2$ represents an alkyl group of 7 to 14 carbon atoms or an alkenyl group of 7 to 14 carbon atoms; and Z represents —O— or —NH—

[Chemical Formula 4]

$$—(CH_2CH_2NH)— \quad (IV);$$

a component (C): a carboxylic acid or a salt thereof selected from the group consisting of an aliphatic carboxylic acid of 4 to 12 carbon atoms or a salt thereof (C1) and an aromatic carboxylic acid of 7 to 12 carbon atoms or a salt thereof (C2); and a component (D): an amine compound (D2) having a branched alkanol group, represented by general formula (VI)

[Chemical Formula 6]

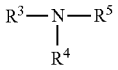

(VI)

wherein $R^3$, $R^4$, and $R^5$ each independently represent a hydrogen atom or a branched alkanol group of 3 to 6 carbon atoms; provided that all of $R^3$, $R^4$ and $R^5$ are not a hydrogen atom at the same time.

2. The detergent composition for metal according to claim 1, wherein the component (B) is the amine compound (B1).

3. The detergent composition for metal according to claim 2, wherein the component (C) is the aliphatic carboxylic acid of 4 to 12 carbon atoms or a salt thereof (C1).

4. The detergent composition for metal according to claim 1, wherein the component (A) is the polyoxyalkylene alkyl ether (A1), and the component (B) is at least one of nitrogen-containing organic compound selected from the group consisting of the alylamine-based polymer (B6) and the polyethylenimine (B5).

5. The detergent composition for metal according to claim 4, wherein the allylamine-based polymer (B6) is at least one selected from the group consisting of a monoallylamine-based polymer (B2) having a weight-average molecular weight of 5,000 to 50,000 and having a structural unit represented by general formula (VII), and a diallylamine-based polymer (B7)

[Chemical Formula 7]

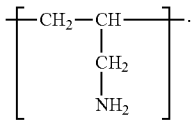

(VII)

6. The detergent composition for metal according to claim 5, wherein the diallylamine-based polymer (B7) is a polymethyldiallylamine hydrochloride (B3) having a weight-average molecular weight of 5,000 to 50,000 and having a structural unit represented by general formula (VIII) or a polydiallyldimethylammonium chloride (B4) having a weight-average molecular weight of 5,000 to 50,000 and having a structural unit represented by general formula (IX)

[Chemical Formula 8]

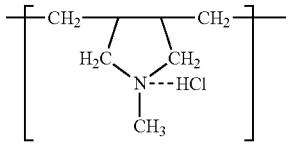

(VIII)

[Chemical Formula 9]

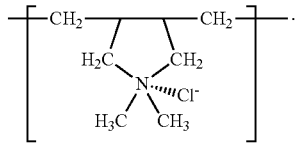

(IX)

7. A detergent composition for metal comprising a component (A), a component (B), a component (C) and a component (D) as described below, and having a pH of at least 9 that is measured at 25° C. when the detergent composition is diluted to 1% by mass of an aqueous solution;

a component (A): a polyoxyalkylene alkyl amine (A2) represented by general formula (II);

[Chemical Formula 2]

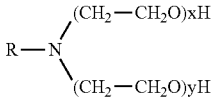

(II)

wherein R represents an alkyl group of 8 to 18 carbon atoms or an alkenyl group of 8 to 18 carbon atoms; X and Y represents the average number of moles of ethyleneoxy group; the sum of X and Y is an integer of 3 to 10;

a component (B): a nitrogen-containing organic compound of at least one selected from the group consisting of an amine compound (B1) represented by general formula (III), an allylamine-based polymer (B6) having a weight-average molecular weight of 5,000 to 50,000 and a polyethylene imine (B5) having a weight-average molecular weight of 5,000 to 50,000 and having a structural unit represented by general formula (IV)

[Chemical Formula 3]

$$R^2—Z—(CH_2)_3—NH_2 \quad (III)$$

wherein $R^2$ represents an alkyl group of 7 to 14 carbon atoms or an alkenyl group of 7 to 14 carbon atoms; and Z represents —O— or —NH—

[Chemical Formula 4]

$$—(CH_2CH_2NH)— \quad (IV);$$

a component (C): a carboxylic acid or a salt thereof selected from the group consisting of an aliphatic carboxylic acid of 4 to 12 carbon atoms or a salt thereof (C1) and an aromatic carboxylic acid of 7 to 12 carbon atoms or a salt thereof (C2); and a component (D): an alkanol amine compound of at least one selected from the group consisting of an amine compound (D1) having a linear alkanol group, represented by general formula (V) and an amine compound (D2) having a branched alkanol group, represented by general formula (VI)

[Chemical Formula 5]

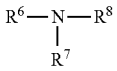

(V)

wherein $R^6$, $R^7$, and $R^8$ each independently represent a hydrogen atom or a linear alkanol group of 2 to 4 carbon atoms; provided that all of $R^6$, $R^7$ and $R^8$ are not a hydrogen atom at the same time

[Chemical Formula 6]

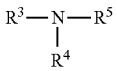

(VI)

wherein $R^3$, $R^4$, and $R^5$ each independently represent a hydrogen atom or a branched alkanol group of 3 to 6 carbon atoms; provided that all of $R^3$, $R^4$ and $R^5$ are not a hydrogen atom at the same time.

8. The detergent composition for metal according to claim 7, wherein the component (B) is the amine compound (B1).

9. The detergent composition for metal according to claim 7, wherein the component (D) is the amine compound (D1) having a linear alkanol group.

10. The detergent composition for metal according to claim 7, wherein the component (D) is the amine compound (D2) having a branched alkanol group.

11. The detergent composition for metal according to claim 7, wherein the component (B) is at least one of nitrogen-containing organic compound selected from the group consisting of the allylamine-based polymer (B6) and the polyethylenimine (B5).

12. The detergent composition for metal according to claim 11, wherein the component (D) is the amine compound (D1) having a linear alkanol group.

13. The detergent composition for metal according to claim 11, wherein the component (D) is the amine compound (D2) having a branched alkanol group.

14. The detergent composition for metal according to claim 12, wherein the allylamine-based polymer (B6) is at least one selected from the group consisting of a monoallylamine-based polymer (B2) having a weight-average molecular weight of 5,000 to 50,000 and having a structural unit represented by general formula (VII), and a diallylamine-based polymer (B7)

[Chemical Formula 10]

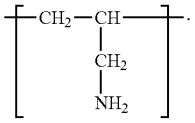

(VII)

15. The detergent composition for metal according to claim 14, wherein the diallylamine-based polymer (B7) is a polymethyldiallylamine hydrochloride (B3) having a weight-average molecular weight of 5,000 to 50,000 and having a structural unit represented by general formula (VIII) or a polydiallyldimethylammonium chloride (B4) having a weight-average molecular weight of 5,000 to 50,000 and having a structural unit represented by general formula (IX)

[Chemical Formula 11]

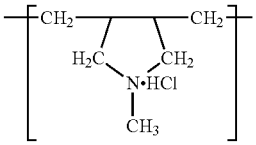

(VIII)

[Chemical Formula 12]

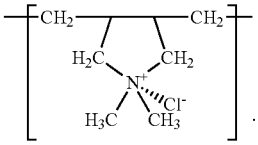

(IX)

16. The detergent composition for metal according to claim 1, further containing a sodium silicate.

17. The detergent composition for metal according to claim 1, wherein the total amount of the component (A), the component (B), the component (C) and the component (D) is greater than or equal to 50% by mass, relative to the total amount of the detergent composition as high as 100% by mass, and the amount of the component (A), the amount of the component (B), the amount of the component (C) and the amount of the component (D) each fulfills the following formula: {(the amount of the component (A))+(the amount of the component (B))}/{(the amount of the component (C))+(the amount of the component (D))}≤0.6.

* * * * *